United States Patent [19]

Babcock et al.

[11] Patent Number: 4,655,646

[45] Date of Patent: Apr. 7, 1987

[54] MULTITIERED, RIGID TIEBACK, ESSENTIALLY VERTICAL RETAINING WALL SYSTEM

[75] Inventors: John W. Babcock, Huntsville, Utah; Ronald K. Wormus, Fort Collins, Colo.

[73] Assignee: Stresswall International, Inc., Denver, Colo.

[21] Appl. No.: 874,425

[22] Filed: Jun. 16, 1986

[51] Int. Cl.[4] ..... E02D 5/00; E02D 17/00

[52] U.S. Cl. ..... 405/286; 405/284; 405/258

[58] Field of Search ..... 405/284–287, 405/262, 258; 52/234, 432

[56] References Cited

U.S. PATENT DOCUMENTS

| | | | |
|---|---|---|---|
| 1,356,319 | 10/1920 | Smulski | 405/286 |
| 1,778,573 | 10/1930 | Thornley | 405/286 |
| 1,909,299 | 5/1933 | Mette | 405/284 |
| 2,908,139 | 10/1959 | Horton et al. | 405/284 |
| 3,226,894 | 1/1966 | Burchardt et al. | 52/227 X |
| 3,802,205 | 4/1974 | Dickinson | 405/285 |
| 4,050,254 | 9/1977 | Meheen et al. | 405/286 X |
| 4,260,296 | 4/1981 | Hilfiker | 405/287 X |
| 4,278,364 | 7/1981 | Frebner | 405/284 X |
| 4,341,491 | 7/1982 | Neumann | 405/284 X |
| 4,384,810 | 5/1983 | Neumann | 405/284 |

FOREIGN PATENT DOCUMENTS

| | | | |
|---|---|---|---|
| 2549162 | 12/1977 | Fed. Rep. of Germany | 405/284 |
| 321875 | 9/1902 | France | 405/284 |
| 747703 | 4/1933 | France | 405/287 |
| 8814 | of 1900 | United Kingdom | 405/286 |
| 1402 | of 1908 | United Kingdom | 405/284 |

*Primary Examiner*—Dennis L. Taylor

*Attorney, Agent, or Firm*—Robert C. Dorr

[57] ABSTRACT

A retaining wall system which provides an essentially a vertical wall without vertically aligned protrusions. The multitiered retaining wall system uses a plurality of tieback elements which act independently of each other to prevent the transference of forces and moments to lower tiers. The design provides a high degree of flexibility in the horizontal spacing of the tieback elements, which is independent of the width of the retaining wall panel, so as to meet specified technical conditions and allow the use of standard size prefabricated concrete components.

5 Claims, 7 Drawing Figures

MULTITIERED, RIGID TIEBACK, ESSENTIALLY VERTICAL RETAINING WALL SYSTEM

BACKGROUND OF THE INVENTION

1. Field of Invention

The present invention pertains generally to retaining walls and more specifically to retaining walls using rigid tieback elements.

2. Description of the Background

Various retaining wall systems have been used in the prior art for retaining soil, i.e., loam, sand, dirt or any other type of earthen material. One broad classification of retaining wall systems is the stabilized earth system which generates a stabilized earth mass behind the retaining wall to reduce the likelihood of failure of the retaining wall. Typical techniques include the use of graded backfill and flexible tieback elements which help to form the stabilized earth mass.

Another broad classification of retaining wall systems is the static, leverage wall system, such as disclosed in U.S. Pat. No. 4,050,254 issued Sept. 27, 1977 to Meheen, et al. Design analysis of such static, leverage wall systems is accomplished by summing the forces on the rigid horizontal tieback element and comparing them with the horizontal component of soil forces acting on the face of the wall. The horizontal tieback base is then increased in size and length until the vertical forces on the tieback element exceed the horizontal component of the soil forces by a predetermined factor of safety. In other words, the leverage wall systems use a standard statics approach to analyzing the wall and sum the forces to provide a factor of safety which ensures that the overturning moments do not exceed the horizontal forces on the tieback elements by a predetermined factor of safety. This results in retaining walls having extremely long tieback elements, such as disclosed in Meheen et al., which require a large cut into the backfill material to erect the wall, or walls which have extremely large and heavy base portions, such as conventional, poured in place, cantilevered walls. Consequently, static leverage wall systems have not been suitable for implementation as high vertical walls because of the required cut into the backfill, or the large expense of constructing poured-in-place cantilevered walls which are expensive to pour and require an extremely large amount of concrete. Also, because of the unsuitability of leverage wall systems as high vertical walls, e.g. over 20 feet, they have generally been implemented as tiered walls with each successively higher tier set back into retained soil, ( such as disclosed in Meheen et al. U.S. Pat. No. 4,050,254 issued to Meheen et al. on Sept. 27, 1977 is specifically incorporated herein by reference and made a part of this document for all that it discloses.

U.S. Patent Application Ser. No. 773,328 filed Sept. 6, 1985 by Babcock et al. entitled "Retaining Wall System Using Soil Arching" discloses a multitiered retaining wall system which employs soil arching to produce a substantially vertical wall having a series of vertical tiers which individually articulate. The Babcock et al. application discloses a multitiered wall wherein each tier acts independently of other tiers (articulates) and generates shears and soil arching over each of the footings which extend into the soil to maintain the stability of the wall. The face of the wall system disclosed in the Babcock et al. application, referred to above, has a "shiplap" design and each of the column portions of the tieback elements protrudes by a predetermined distance from the face of the retaining wall panels. In certain instances, such as when a wall is installed adjacent a roadway, it is desirable to have a smooth faced wall without vertical column portions projecting from the wall to reduce the likelihood of contacting the vertically aligned projection with a motor vehicle. Consequently, it is desirable, in certain instances to provide a retaining wall which does not have vertically aligned projections.

Additionally, when using prefabricated concrete components in a retaining wall, it is desirable to use standardized pieces to reduce costs in the fabrication process. However, geotechnical conditions necessitate variations in the height of each tier of the retaining wall as well as the spacing between the tieback elements. Either different size elements must be fabricated, which increases the cost of fabrication due to additional costs for forms and other factors, or the wall must be designed for the most stringent design requirements, which results in a failure to optimize the design criteria of the retaining wall system. Consequently, some flexibility is desirable in the implementation of the retaining wall system to provide optimum design parameters which result in cost savings.

SUMMARY OF THE INVENTION

The present invention overcomes the disadvantages and limitations of the prior art by providing a retaining wall system which does not incorporate vertically aligned protrusions and which is capable of providing a high degree of flexibility for the geotechnical conditions. The present invention provides an essentially vertical retaining wall system which employs inventive features disclosed in the above-referenced Babcock et al. application such as articulating tiers, i.e., the ability of each tier of the multitiered retaining wall to act independently of other tiers, causing forces to be transferred directly into the soil through the tieback element of each tier rather than being transferred to the bottom of the wall, and the use of soil arching to maintain stability of the wall.

The present invention may therefore comprise a multitiered essentially vertical retaining wall system for retaining soil comprising grade beam means disposed along a lowermost portion of the retaining wall system; wall panel means for retaining the soil in response to soil forces having vertical and horizontal components which are generated by the soil acting on the wall panel means, the wall panel means having a standardized predetermined height and width and vertically aligned along a predetermined plane; rigid tieback means disposed in the soil behind the wall panel means at intervals which vary in accordance with geotechnical conditions independently of the width of the wall panel means; coupling means horizontally disposed along upper and lower portions of the wall panel means for transferring the horizontal component of the soil forces acting on the wall panels to the tieback means which produces a moment on the tieback means which is resisted by a vertical component of soil forces acting on the tieback means causing the moment to be resolved into the soil to produce soil arching, the coupling means disposed to provide sufficient vertical space between the coupling means and the tieback means and said coupling means and said wall panel means to prevent transference of the moment to adjacent tiers.

The advantages of the present invention are that it provides flexibility in the design and implementation of the wall while maintaining the use of standardized components. For example, the tieback elements can be spaced at any desired interval behind the wall regardless of the size of the wall panels used. Additionally, the present invention can be employed where grade changes occur while maintaining vertically aligned components by employing wall panels formed in a parallelogram shape. This greatly facilitates the use of the wall system. Additionally, the lack of vertically aligned protrusions from the wall decreases the danger associated of a vehicle impacting the wall.

DETAILED DESCRIPTION OF THE INVENTION

Figure 1:
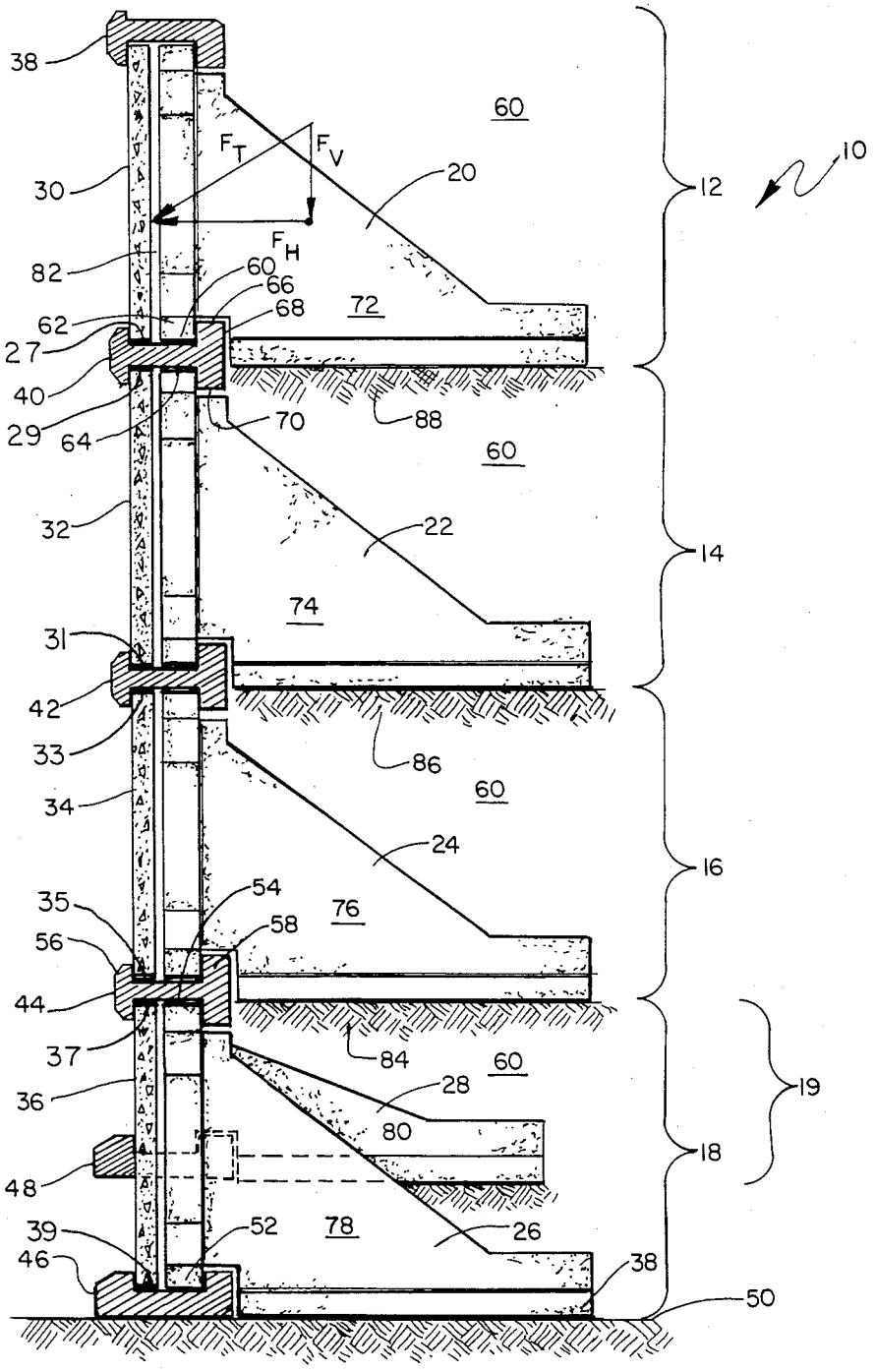
FIG. 1 is a schematic side view of the retaining wall system of the present invention.

FIG. 1 is a schematic side view of the retaining wall system 10 of the present invention illustrating the series of multiple tiers 12, 14, 16, 18. The components of the retaining wall systems comprise tieback elements 20, 22, 24, 26, 28, wall panels 30, 32, 34, 36, coupling means 38, 40, 42, 44 and a grade beam 46. Tieback element 28 is used in conjunction with a 4 foot retaining wall panel to facilitate grade changes and is shown schematically disposed some distance behind tieback unit 26. Tieback unit 28 engages an additional grade beam means 48 which is disposed on an additional graded surface.

To construct the retaining wall system 10 of the present invention, it is necessary to excavate and grade a surface 50 upon which grade beam 46 is placed. Grade beam 46 can either be poured in place or can be fabricated in a prefabrication plant and placed on the graded surface 50. Tieback element 26 is then placed in a position such that a gap is provided to allow vertical movement between tieback element 26 and grade beam 46. The gap provided between the horizontal surfaces of flange portion 52 and grade beam 46 allows the moment induced by horizontal forces of the backfill on wall panel 36 to be transferred to grade beam 46 and resolved into the soil through tieback element 26. Tieback element 28 and grade beam 48 are disposed on another horizontally displaced surface at some predetermined distance spaced from tieback element 26 to facilitate large changes in the grade of the retaining wall. Similarly, a wall panel which is half the height of wall panel 36 is used in conjunction with tieback element 28 and grade beam 48.

Coupling means 44 has a flat connector means 54 connected to a first transverse portion 56 which engages a lower portion of wall panel 34 and an upper portion of wall panel 36. The horizontal surfaces of wall panel means 34 and 36, as well as vertical portions, are separated from the coupling means 44 by elastomeric bearing pads 35, 37 so that the vertical component of forces on the wall panel means are not transferred to grade beam 46. Elastomeric bearing pads 31, 33 are also provided between wall panels 32, 34 and coupling means 42 to prevent transference of the vertical component of the soil force from wall panel 32 through coupling means 42 to wall panel 34. Elastomeric bearing pads 27, 29 are also provided between wall panels 30, 32 and coupling means 40. Elastomeric bearing pad 39 separate wall panel 36 from grade beam 46.

A space is provided between both the upper and lower portions of the tieback means 20, 22, 24, 25, 28, and coupling means 38, 40, 42, 44, to also prevent the vertical components of forces and moments acting on tieback means 20, 22, 24, 26, 28 from being transferred through the coupling means 40, 42, 44. Rather, the vertical components of forces and moments acting on the tieback means are resolved into the soil backfill 60 behind the tieback means to generate arching over the substantially horizontally oriented tieback elements and thereby stabilize movement of the articulating tiers.

The soil backfill 60, which is retained by the retaining wall system 10, generates a soil force $F_T$ which acts in an outward and downward direction and has a horizontal component ($F_H$) and a vertical component ($F_V$).

The horizontal component ($F_H$) is transferred to the tieback means through the coupling means and generates a moment which tends to rotate the tieback means in a counter-clockwise direction. Considering the uppermost tier 12, a gap 60 is provided between the bottom of the flange portion 62 and the top surface of the horizontal connection means of coupling device 40 so that the moment generated on tieback 20 is not transferred to coupling means 40. An additional gap 64 is provided between coupling means 40 and tieback 22 to insure that vertical forces acting on coupling means 40 are not transferred to tieback 22. Mutual vertical surfaces which interconnect the tieback means with the coupling means are capable of transferring the horizontal component ($F_H$) of forces acting on the wall panels, as well as the horizontal components of forces acting on the tieback means. In a similar manner, gaps 66 and 68 also prevent the transference of forces from coupling means 40 to tieback 20. Gap 70 prevents the transference of vertical forces from coupling means 40 to tieback 22. Hence, it can be seen that moments resulting from horizontal forces are not transferred between the separate tiers 12, 14, 16, 18 of the multiple tiered retaining wall system 10, but rather, are resolved into the soil mass 60 retained by the retaining wall system 10 to produce active arching at each tier and provide an articulating wall system. Additionally, a gap 82 is provided between tieback 20 and wall panel 30 to prevent the transference of moments from tieback 20 to wall panel 30. Similar gaps are provided on the other tiers 14, 16, 18.

Each of the tiers of the multitiered retaining wall system 10 are placed in position in a similar manner. For example, tieback element 24 of tier 16 is placed on a graded surface 84 which comprises compacted and graded backfill placed over tier 18 after the grade beam 46, tieback 26, wall panel 36 and coupling means 44 are placed in position. Similarly, the backfill 60 is compacted in the second tier around tieback means 24, wall panel 34, and coupling means 42 and graded to form surface 86 on which tieback means 22 is placed for erection of tier 14. This process continues in a similar manner to form graded surface 88 on which tieback means 20 is placed. As can be seen from FIG. 1, the graded surfaces 50, 84, 86, 88 must be graded with the necessary degree of precision to provide the proper compaction and proper location of the surface to produce the vertical spacing necessary to provide gaps 60, 66. Grading of these surfaces within a several inch tolerance is well within the ability of current construction techniques using automated grading equipment. Gaps 64 and 70 are also maintained by the proper grading of surfaces 50, 84, 86, 88.

Each of the tiebacks 20, 22, 24, 26, 28 have web means 72, 74, 76, 78, 80 which provide a surface area that engages the backfill soil 60 and resulting in integral movement of a first block of the soil 60 surrounding the web means and the generation of shears between the first block of soil 100 (FIG. 3) and the second block of soil 102 (FIG. 3) surrounding the first block of soil 100. The shears generated between the first block of soil and the second block of soil 102 support the tieback means and cause the moments and other forces acting on the tiebacks to be resolved into the soil. This ensures active soil arching with very little movement of the tieback element which results in the transference of the forces and moments into the soil 60. In other words, the tieback elements are designed to move to produce an articulating wall system for the purpose of generating shears and active soil arching over the tieback elements so that standard static leverage forces do not have to be relied upon to support the multitiered wall. These concepts are more fully disclosed in the above referenced Babcock et al. U.S. patent application.

Figure 2:
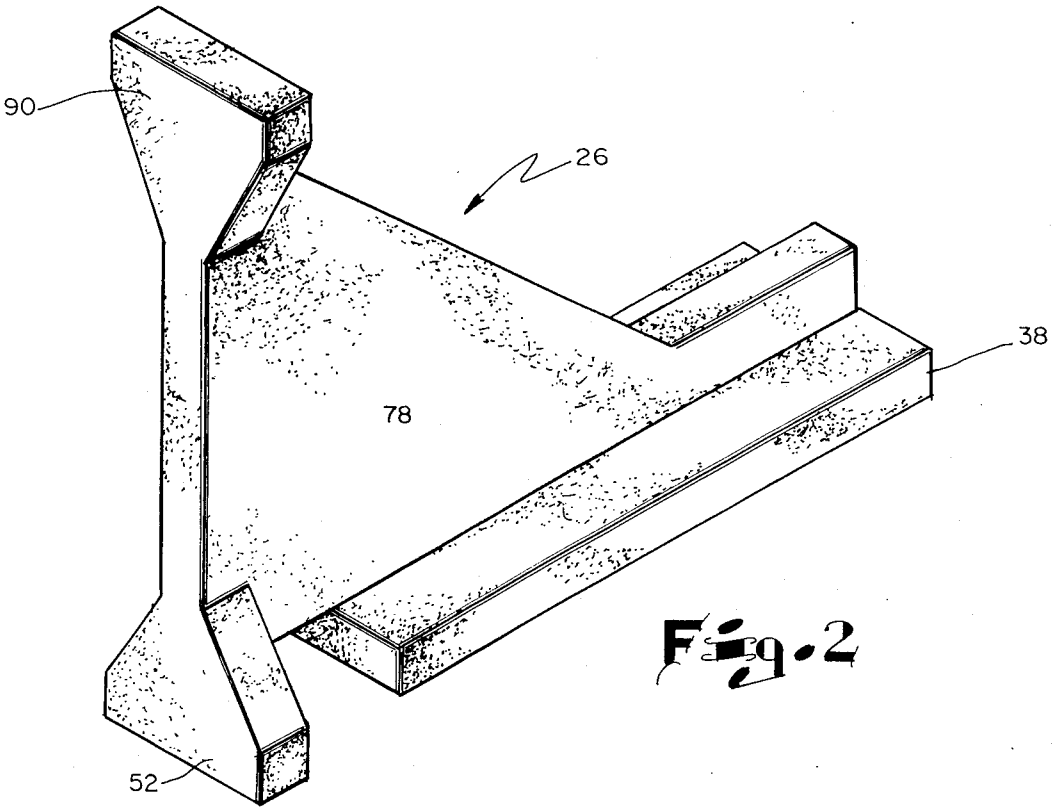
FIG. 2 is a schematic isometric view of a tieback element used in the present invention.

FIG. 2 is an isometric diagram of a typical tieback element such as tieback element 26. Tieback means 26, illustrated in FIG. 2, comprises a prefabricated component which is constructed of concrete or other similar material in a concrete prefabrication plant. Tieback 26 has a web 78 which is coupled to a transversely mounted base flange 38 extending from the web 78 in a substantially horizontal direction. Base portion 38 is placed on graded surface 50 to support the rigid tieback 26 and distribute moments and forces to soil 60 surrounding tieback 26. Column flange portions 52, 90 are aligned substantially transversely to web 78 and provide an enlarged surface area for distributing horizontal forces so as to decrease the pressure acting on the column flange portions 52, 90. The enlarged surface area of column portions 52, 90 also ensures that tieback 26 maintains engagement with the coupling means during implementation of the system.

Figure 3:
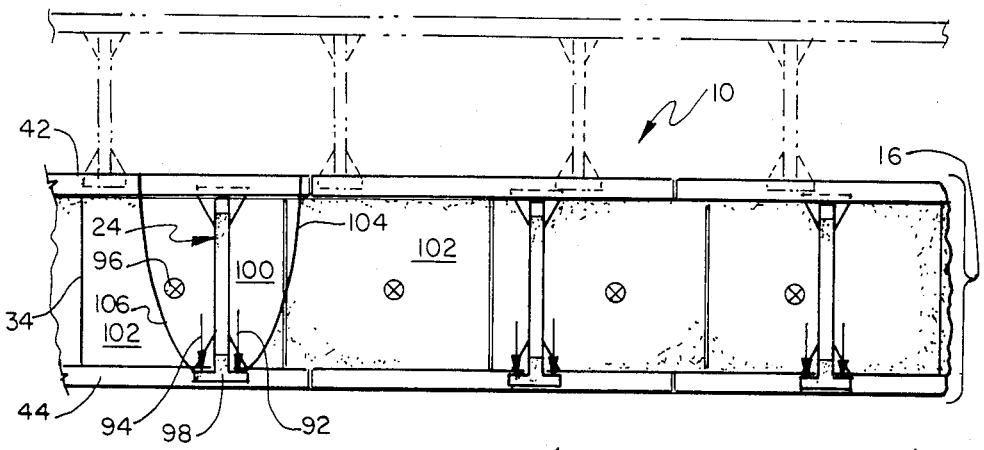
FIG. 3 is a schematic back view of the components used in the retaining wall system of the present invention.

FIG. 3 is a schematic rear view of a single tier, such as tier 16, of retaining wall system 10. The various tieback elements are spaced at intervals which differ from the spacing of the wall panel means and the coupling means. In other words, the tieback means can be spaced at any desired interval behind the wall panels or the width of the coupling means. This feature of the present invention provides a high degree of flexibility to meet varying geotechnical conditions. For example, some tiers, or some portions of a single tier, may require additional tiebacks units to transfer additional forces on a particular tier, or a particular portion of a single tier, into the soil. In this case, the tieback means can be spaced at short intervals to provide additional support without changing the width (horizontal dimensions) of the wall panel or coupling means. Similarly, in areas where less support is needed, the tieback elements can be spaced at wider intervals without changing the width (horizontal dimensions) of either the wall panel or the coupling means. Consequently, the tieback means, coupling means and wall panel means can be fabricated to a standard predetermined size in a prefabrication plant and can be implemented in a wall system without the necessity for custom-made pieces which necessarily increase the overall cost of the wall system and may delay its installation. The use of standardized pieces allows the pieces to be used interchangeably, which reduces costs and allows quick and easy installation of the system without confusion.

FIG. 3 also illustrates the manner in which forces act on the wall panels and the tiebacks. For example, the horizontal component ($F_H$) of the soil forces acting on wall panel 34 is shown as resultant force 96 which acts on the center of panel 34 at a distance which is slightly higher than one third of the distance from the bottom of the panel. The gradient of forces from soil behind wall panel 34 forms a triangularly shaped force diagram which has a resultant force acting one third of the distance from the bottom of the panel 34. A surcharge from forces of higher tiers has a rectangularly shaped force diagram which has a resultant force acting halfway between the top and bottom of panel 34. The resultant of these two forces is a force 96 which is slightly higher than one third of the distance from the bottom of the panel.

The horizontal component of force 96 acting on panel 34 is transferred to tieback 24 to produce an overturning moment on tieback element 24. Because of the gaps provided between tieback 24 and coupling means 42 and 44, vertical forces 92, 94, acting on base flange means 98 of tieback 24, cause the moment generated by force 96 to be resolved into the soil backfill 60 to cause active arching of the soil over the tieback elements. Shears 104, 106 separate a first block 102 of the soil 60, which is between shears 104, 106, from a second block 102 of soil 60, which is outside of shears 104, 106. Shears 104, 106 greatly increase the magnitude of forces 92, 94 generated by the first block of soil 100 upon movement of tieback 98 in an upward direction because of the active earth forces (arching) generated. This is more fully explained in "Soil Engineering", 4th Edition, Merlin G. Splanger, Richard L. Handy, Chapter 26, Harper and Rowe Publishers, New York, 1982.

Figure 4:
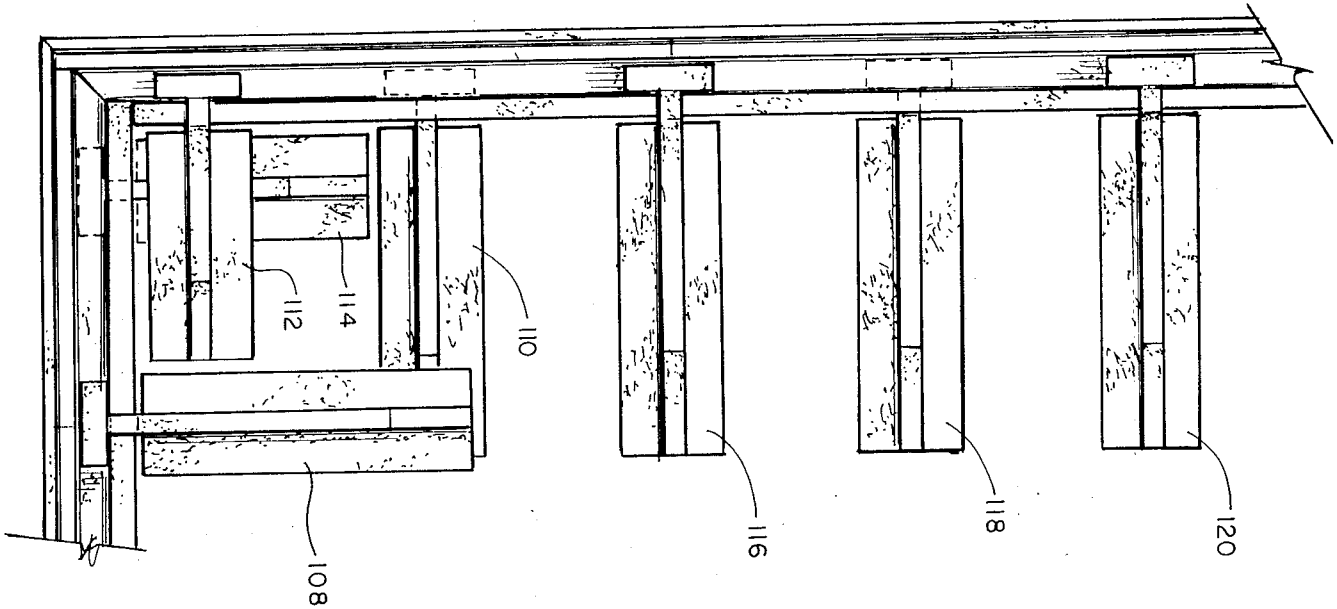
FIG. 4 is a schematic top view of the components used in accordance with the present invention.

FIG. 4 is a top view of the present invention illustrating the manner in which a corner is formed using the retaining wall system of the present invention. Standard size tieback units 108, 110 are used adjacent the corners to provide sufficient stability to maintain the wall system in response to soil pressures in corner positions. Additionally, standard size tieback units 116, 118, 120 can be used in an alternating fashion on different tiers of the retaining wall system.

Figure 5:
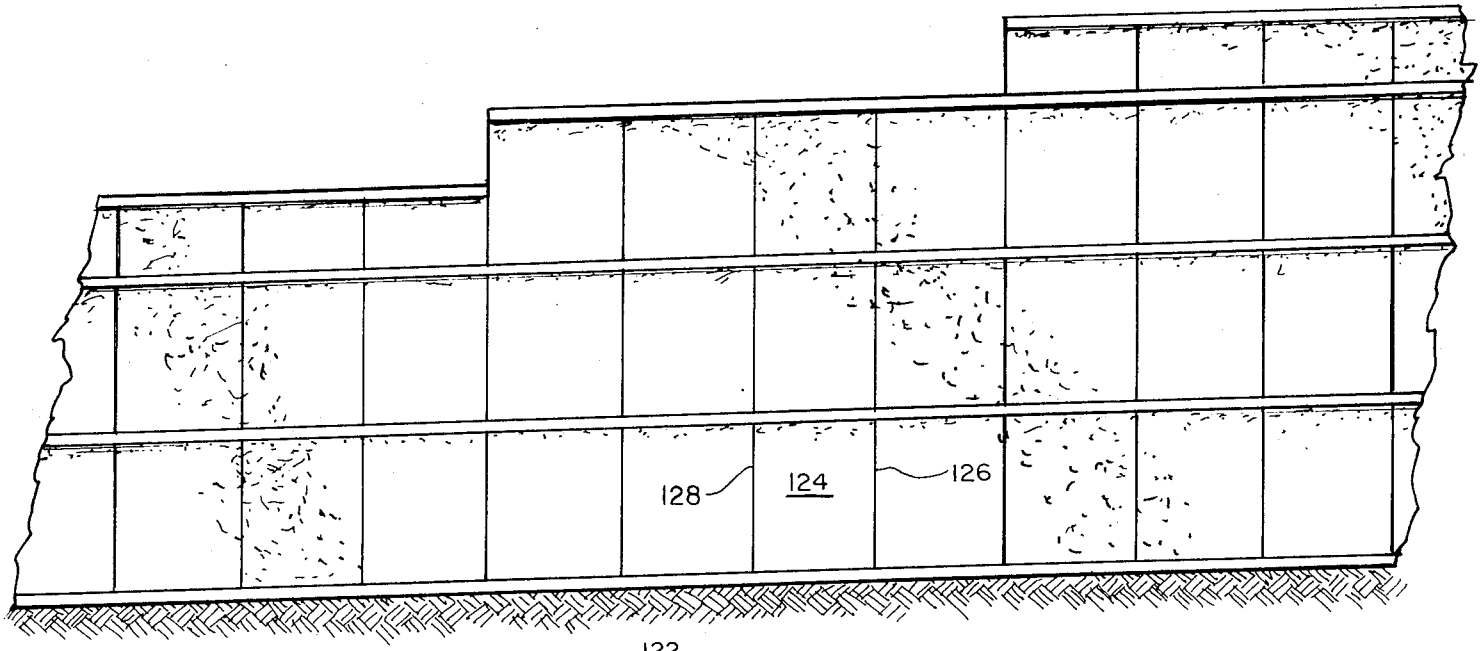
FIG. 5 is a schematic front view of the retaining wall system of the present invention implemented on an inclined slope with an inclined road surface at the bottom of the wall system.

FIG. 5 is a schematic front view of a portion of an alternative embodiment of the present invention. As illustrated in FIG. 5, the retaining wall system is disposed on graded slope 122. In order to maintain the vertical orientation of the wall, the wall panels, such as wall panel 24, are formed in a parallelogram. This causes the sides of the wall panels 126, 128 to be oriented to a vertical direction.

Figure 6:
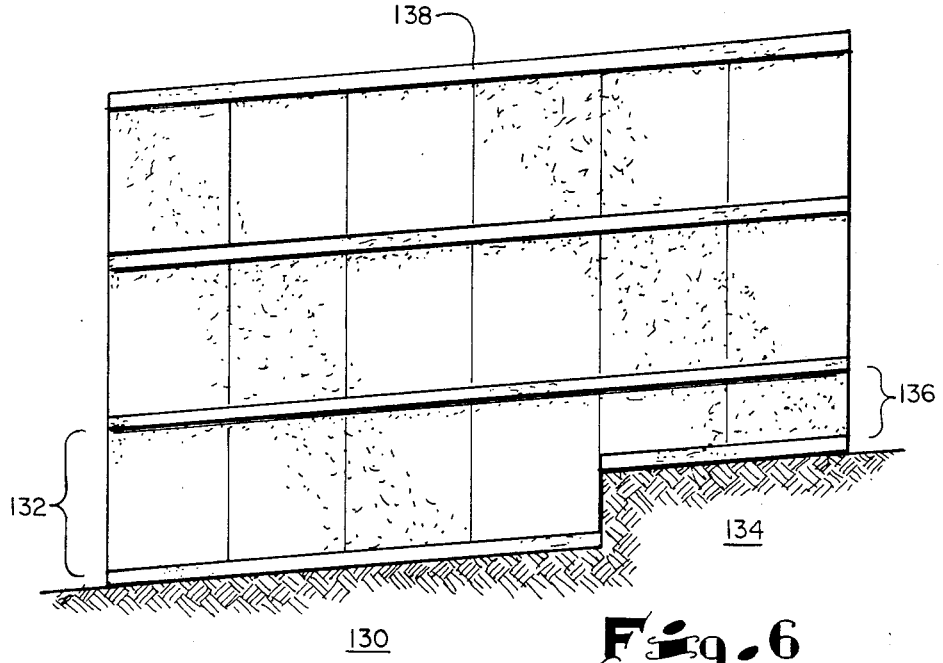
FIG. 6 is a,schematic front view of the retaining wall system of the present invention implemented on an inclined slope with an inclined road surface at the top of the wall system.

FIG. 6 illustrates a different implementation of the embodiment illustrated in FIG. 5. For large grade changes, the present invention can be implemented as tiers wherein wall panels, having half the vertical height, can be used in a stepwise fashion to implement the system on a changing terrain. As illustrated in FIG. 6, a full-size tier 132 is placed on graded slope 130 which can have a slope such as illustrated in FIG. 6. A half size tier 136 is placed in a similar manner on a graded slope 134 to accommodate large changes in grade. The retaining wall can then provide a sloped top surface 138 on which a roadway can be placed. The implementation illustrated in FIG. 6 can be used with either an inclined grade or a flat grade. FIG. 1 illustrates the half wall panel which is implemented as tier 19.

Figure 7:
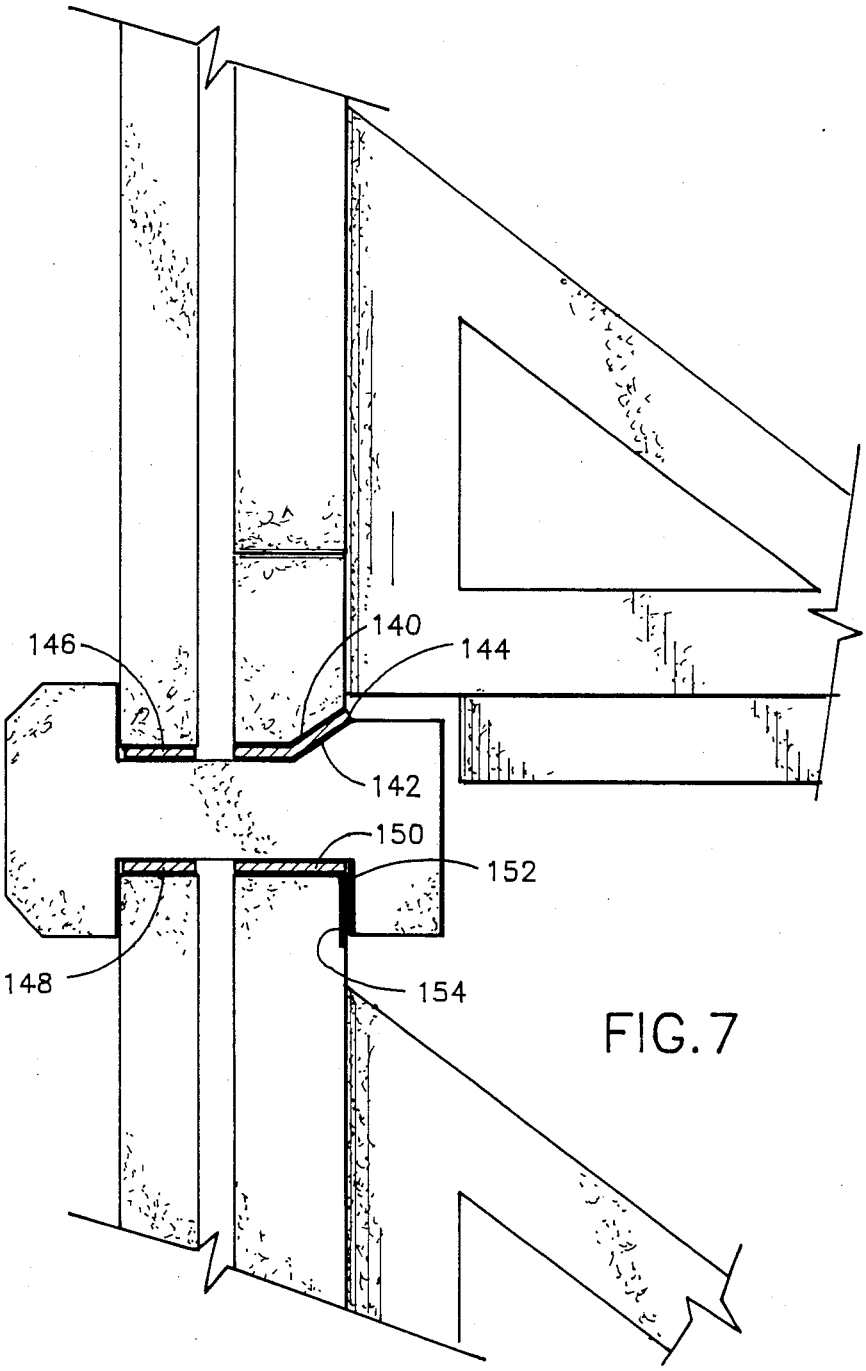
FIG. 7 is a schematic side view of an alternative embodiment of the wall system of the present invention.

FIG. 7 is a schematic side view of an alternative embodiment of the present invention. FIG. 7 illustrates an inclined surface 140 of the tieback element which matches an inclined surface of the coupling means. An elastomeric bearing pad 144 is placed between the surfaces of the tieback element in the coupling means to ensure that a gap is provided between the tieback means and the coupling means. If the moment forces induced by the horizontal component of forces on the wall panel caused the tieback to rotate to compress the elastomeric bearing pad 144, the mutual surfaces of the tieback element in the coupling means will engage so that the tieback element becomes keyed into the coupling means and the total horizontal surface portions of the coupling means then function in conjunction with the tieback element to resist the overturning moment. This acts somewhat as a safety feature in preventing excess movement, or articulation, of each of the tiers.

FIG. 7 also illustrates elastomeric bearing pads 146, 148 which are placed between the wall panels and the coupling means. An elastomeric bearing pad 150 can also be placed between the coupling means and a lower tieback element. Teflon coated surfaces 152, 154 can also be provided to allow movement between the tieback element and the coupling means and thereby prevent the transference of vertical forces due to high coefficients of friction.

The present invention therefore provides a retaining wall system which has a high degree of design flexibility and which eliminates vertically orientated protrusions from the wall so as to reduce hazards resulting from implementation of the wall next to a roadway. The present invention also provides for the use of a series of tieback elements which can be placed at intervals which are independent of the horizontal dimensions of other components of the system. This allows the system to use interchangeable parts which can be simply and easily prefabricated in a concrete prefabrication plant. Since the tieback units of each of the tiers acts independently of other tiers, forces and moments transferred to the tieback elements are resolved into the soil surrounding the tieback elements for each tier to produce soil arching and allow the wall to have separately articulating tiers, rather than the entire wall acting as a single unit. This allows the wall to be used with a reduced cut in the backfill for the vertical height of the wall as compared to conventional static, leverage walls.

The foregoing description of the invention has been presented for purposes of illustration and description. It is not intended to be exhaustive or to limit the invention to the precise form disclosed and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A multitiered essentially vertical retaining wall system for retaining soil comprising:

grade beam means disposed along a lowermost portion of said retaining wall system;

wall panel means for retaining said soil in response to soil forces having vertical and horizontal components which are generated by said soil acting on said wall panel means, said wall panel means having a standardized predetermined height and width and vertically aligned along a predetermined plane;

rigid tieback means disposed in said soil behind said wall panel means at intervals which vary in accordance with geotechnical conditions independently of said width of said wall panel means;

coupling means horizontally disposed along upper and lower portions of said wall panel means for transferring said horizontal component of said soil forces acting on said wall panels to said tieback means to produce a moment on said tieback means which is resisted by soil forces acting on said tieback means causing said moment to be resolved into said soil to produce soil arching, said coupling means disposed to provide sufficient vertical space between said coupling means and said tieback means and said coupling means and said wall panel means to prevent transference of said moment to adjacent tiers of said multitiered retaining wall system.

2. The retaining wall system of claim 2 wherein said tieback means comprises:

web means having a surface area sufficiently large to engage a first block of soil adjacent said web means and cause integral movement of said first block of soil to ensure generation of shears between said first block of said soil and a second block of soil surrounding said first block of soil to cause soil arching;

base flange means which extend transversely from said web means in a substantially horizontal direction to support said rigid tieback means and distribute said moment into said soil.

3. The retaining wall system of claim 2 wherein said base member means is wedge shaped to resist pull-out forces.

4. The retaining wall system of claim 2 wherein said tieback means further comprises:

flange portion means aligned substantially transversely to said web means to provide a surface area for distributing horizontal forces generated between said tieback means and said coupling means and for maintaining engagement of said tieback means with said coupling means.

5. The retaining wall system of claim 4 wherein said coupling means comprises:

flat connector means horizontally disposed to extend between said wall panel means and said tieback means;

first transverse portion means connected to said flat connector means for engaging said wall panel means along substantially vertically disposed surfaces;

second transverse portion means connected to said flat connector means for engaging said tieback means along a substantially vertical surface and maintaining a space between horizontal surfaces to prevent transference of said moment to lower tiers of said multitiered retaining wall system.

* * * * *